United States Patent [19]

Judd

[11] 4,162,900

[45] Jul. 31, 1979

[54] COMPOSITION HAVING IMPROVED WEAR RESISTANT AND COMPRESSION RESILIENT PROPERTIES

[75] Inventor: Oliver S. Judd, Arlington, Tex.

[73] Assignee: The Hutson Corporation, Arlington, Tex.

[21] Appl. No.: 722,813

[22] Filed: Sep. 13, 1976

[51] Int. Cl.[2] ..... B24D 3/32

[52] U.S. Cl. ..... 51/295; 51/298; 51/299; 51/DIG. 30; 428/325; 428/329; 428/425

[58] Field of Search ..... 51/295, 298, 299, DIG. 30; 428/325, 329, 331, 425

[56] References Cited

U.S. PATENT DOCUMENTS

| | | | |
|---|---|---|---|
| 2,899,288 | 8/1959 | Barclay | 51/295 |
| 2,947,124 | 8/1960 | Madigan et al. | 51/309 |
| 3,481,723 | 12/1969 | Kistler et al. | 51/298 |
| 3,607,606 | 9/1971 | Beninga | 428/325 |
| 3,778,241 | 12/1973 | Winter et al. | 51/298 |
| 3,898,361 | 8/1975 | Bjerk et al. | 428/325 |
| 3,916,584 | 11/1975 | Howard et al. | 51/308 |
| 4,038,047 | 7/1977 | Haywood | 51/295 |
| 4,042,085 | 8/1977 | Bjerk et al. | 428/325 |
| 4,051,100 | 9/1977 | Bjerk et al. | 428/325 |
| 4,079,162 | 3/1978 | Metzger | 428/325 |

*Primary Examiner*—Donald J. Arnold

*Attorney, Agent, or Firm*—Richards, Harris & Medlock

[57] ABSTRACT

A composition having improved wear resistant and compression resilient properties is provided comprising an elastomeric substrate having a working surface and a non-working surface, and a plurality of abrasive resistant members randomly positioned within the substrate. The abrasive resistant members are positioned within the elastomeric substrate so that at least certain of the abrasive resistant members are closely adjacent the working surface of the elastomeric substrate. A layer of elastomeric material may be utilized between the abrasive resistant members and the non-working surface of the substrate to provide a cushioning effect.

10 Claims, 6 Drawing Figures

COMPOSITION HAVING IMPROVED WEAR RESISTANT AND COMPRESSION RESILIENT PROPERTIES

BACKGROUND AND SUMMARY OF THE INVENTION

This invention relates to a novel composition having improved wear resistant and compression resilient properties, and more particularly to a composition having a plurality of abrasive resistant members positioned within an elastomeric substrate. In one aspect this invention relates to an improved liner for vibratory-type machines.

Industrial vibratory-type machines, such as vibratory finishing machines, tumbling barrels, and the like have gained relatively widespread commercial acceptance in the finishing or other processing of various parts and items. Such industrial vibratory-type machines may employ a liner to prevent damage to the parts or items being treated and to the machines themselves. For example, a vibratory finishing machine which has gained relatively widespread commercial acceptance incorporates a toroidal bowl or hopper which is annular in shape and U-shaped in cross-section. The toroidal bowl or hopper is provided with a liner, such as a urethane or rubber liner, to prevent damage to the parts or items being treated due to the vibration of the hopper and thus movement of the contents therein. In the use of such a vibratory finishing machine, a suitable media and piece parts to be finished are introduced into the hopper, together with a liquid such as water, and in some instances a finishing agent. Vibratory apparatus is then utilized to effect vibration of the hopper and the contents thereof, whereby the piece parts are processed.

However, liners of vibratory machines have relatively short lives, especially when heavy parts or parts with sharp corners or protrusions are being treated. Liner failures have created many problems in that not only does the operator incur the expense of replacement liners, but also the machine must be drained of the finishing media and shut down when the liner is replaced. Thus, it is desirable that improved liner compositions to be provided which not only provide desired compression resilient properties but also have improved wear resistant properties.

The present invention comprises a composition having improved wear resistant and compression resilient properties which can be employed as a liner in industrial vibratory-type machines, such as vibratory finishing machines, tumbling barrels, and the like. In accordance with the broader aspects of the invention, a composition having improved wear resistant and compression resilient properties is provided which comprises an elastomeric substrate having a working surface and a non-working surface and a plurality of abrasive resistant members positioned within the substrate. The abrasive resistant members are positioned within the substrate so that at least certain of the abrasive resistant members are positioned closely adjacent the working surface of the elastomeric substrate.

In accordance with other aspects of the invention, a layer of elastomeric material may be utilized between the abrasive resistant members and the non-working surface of the substrate to provide a cushioning effect. The cushioning elastomeric layer may be formed integrally with the remainder of the substrate, or may be adhesively secured thereto.

DESCRIPTION OF THE DRAWINGS

A more complete understanding of the invention may be had by reference to the following detailed description when taken in conjunction with the accompanying drawings, wherein.

DETAILED DESCRIPTION

Figure 1:
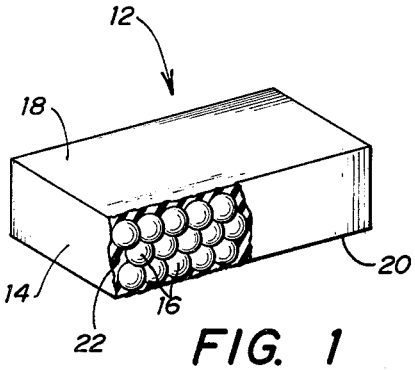
FIG. 1 is a partially broken perspective view of an elastomeric substrate having a plurality of abrasive resistant members positioned therein.
Figure 2:
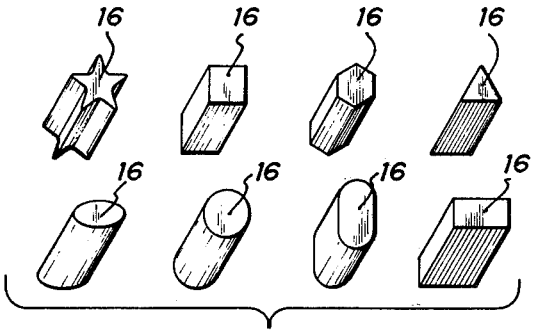
FIG. 2 is a perspective view depicting various configurations of abrasive resistant members that may be utilized in the practice of the invention.

Referring now to the drawings and particularly to FIG. 1 thereof, the composition having improved wear resistant and compression resilient properties of the present invention is illustrated. The composition, generally indicated by 12 is provided with an elastomeric substrate 14 having a plurality of abrasive resistant members 16 positioned therein. Abrasive resistant members 16 can be of any suitable geometric configuration, such as those illustrated in FIGS. 1 and 2. The abrasive resistant members 16 are positioned within elastomeric substrate 14 between the working surface 18 and non-working surface 20 of substrate 14, and the abrasive resistant members 16 typically have thicknesses less than the thickness of substrate 14. Further, abrasive resistant members 16 are positioned within elastomeric substrate 14 so that at least certain of the members 16 are closely adjacent the working surface 18 of the elastomeric substrate 14. The term "working surface" as used herein is to be understood as that surface which is subjected to abrasion and/or friction. The term "non-working surface" is to be understood to be that surface opposite the working surface of the substrate and such surface is not subjected to abrasion and/or friction.

Figure 3:
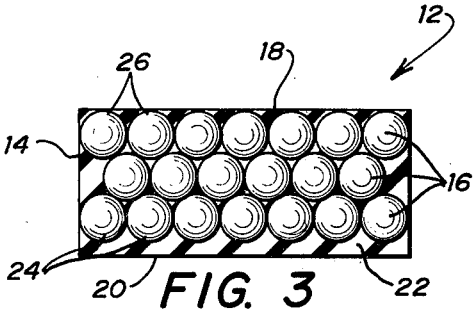
FIG. 3 is a cross-sectional view of an elastomeric substrate having a plurality of abrasive members positioned therein.

By employing the abrasive resistant members 16 within substrate 14, as shown, a cushion 22 is provided by the portion of substrate 14 between the non-working surface 20 of substrate 14 and the inner disposed end portion 24, FIG. 3, of each of the abrasive resistant members 16. The amount of substrate 14 employed to form cushion 22 can vary widely depending upon the thickness of the substrate, the size of the abrasive resistant members, and use of the composition.

Referring now to FIG. 3, a cross-sectional view of the composition 12 of the present invention is shown after formation of same and prior to use. As can readily be seen, substrate 14 may be provided with layers of abrasive resistant members 16 positioned therein. One layer of the abrasive resistant members 16 has surfaces closely adjacent the working surface 18 of the substrate 14. Such is accomplished by normal casting procedures wherein an elastomeric material is received in a mold in a fluid condition and thereafter the respective abrasive members 16 are positioned within the elastomeric material prior to its setting or solidifying. Preferably, abrasive resistant members 16 are positioned within the elastomeric material as it has commenced to harden and form into substrate 14. Abrasive resistant members 16 are positioned within the elastomeric material so as to be slightly below the working surface 18 of the composition 12 while providing cushion 22 between the inner layer of abrasive resistant members 16 and the non-working surface 20 of substrate 14.

Figure 4:
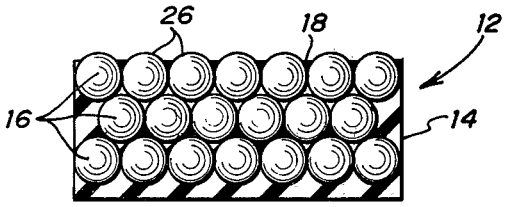
FIG. 4 is a cross-sectional view of the substrate of FIG. 3 after same has been employed as a liner within a vibratory finishing machine.

Referring now to FIG. 4, a comparison of composition 12 is shown after the composition has been used, such as for a liner in an industrial vibratory-type machine. As is evident, as the parts being processed within the vibratory-type machine come in contact with the working surface 18 of substrate 14, a portion of substrate 14 is eroded until the adjacent surfaces of the upper layer of abrasive resistant members 16 are partially exposed. Thereafter, because of the close positioning of the abrasive resistant members 16, the working surface 18 of elastomeric substrate 14 is protected from abrasion and rapid erosion by the components being cleaned and polished.

Figure 5:
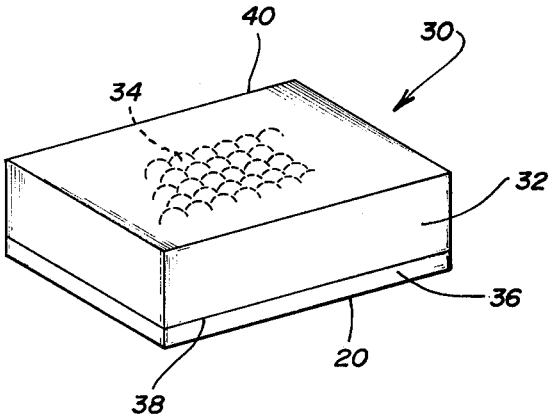
FIG. 5 is a perspective view of an elastomeric substrate having a plurality of abrasive resistant members positioned therein and having a second elastomeric substrate bonded thereto.

Referring now to FIG. 5, another embodiment employing the composition having improved wear resistant and compression resilient properties is shown. Composition 30 is provided with a first elastomeric substrate 32 having a plurality of abrasive resistant members 34 randomly positioned therein, such as shown in FIGS. 1 and 4, and a second elastomeric substrate 36 bonded to the non-working surface 38 of first elastomeric substrate 32. Abrasive resistant members 34 can be of any suitable geometric configuration such as those depicted in FIGS. 1 and 2.

Abrasive resistant members 34 are each positioned within elastomeric substrate 32 between the working surface 40 and the non-working surface 38 of substrate 32. Because of the use of second elastomeric substrate 36 one can, if desired, employ abrasive resistant members 34 of a dimension sufficient to interconnect non-working surface 38 and working surface 40 without sacrificing the compression resilient properties of composition 30. The abrasive resistant members 34 are positioned with the elastomeric substrate 32 so that one surface of each of the abrasive resistant members comprising the outermost layer thereof is closely adjacent the working surface 40 of elastomeric substrate 32. The compression resilient properties of second elastomeric substrate 36 can vary widely depending upon the particular use for which the composition 30 is being produced.

Any suitable elastomer can be employed in producing the composition having improved wear resistant and compression resilient properties of the present invention. The term "elastomeric substrate" as used herein is to be understood to be a substrate formed of either natural or synthetic elastomers which stretch under tension, have a high tensile strength, retract rapidly, and recover their original dimensions fully. Examples of suitable elastomers which can be employed to produce the desired elastomeric substrate of the composition of the present invention are natural rubber, homopolymers such as polychlorobutadiene, polybutadiene and polyisoprene, copolymers such as styrene-butadiene rubber, butyl rubber, nitrile rubber, ethylene-propylene copolymers, fluorine elastomers, and polyacrylates; polycondensation products, such as polyurethanes, silicone rubber, and polysulfide rubber, and chemical conversion of high polymers such as halogen substituted rubber.

In producing the compositions of the present invention having improved wear resistant and compression resilient properties one must, in addition to the elastomeric substrate, employ a plurality of abrasive resistant members as hereinbefore described. The abrasive resistant members can be formed of any suitable abrasive material, both natural or synthetic. The only precaution which must be exercised is that, in order to obtain the desired results, the abrasive material must have sufficient hardness to prevent its rapid deterioration or erosion by the parts or materials being cleaned or polished. Examples of suitable natural abrasives which can be employed as the abrasive resistant members of the composition are diamond, corundum, emery, garnet, silica abrasives such as quartz, quartzite, silica sand, buhrstone, and the like, and other rocks and minerals such as granite, pumice and pumicite, quartz conglomerate, and the like. Suitable synthetic abrasives are diamond, fused alumina, glass, ceramic materials such as hard porcelain, silicon carbide, tantalum carbide, tungsten carbide, and metal abrasives such as steel or iron shot, angular grit, and the like.

Figure 6:
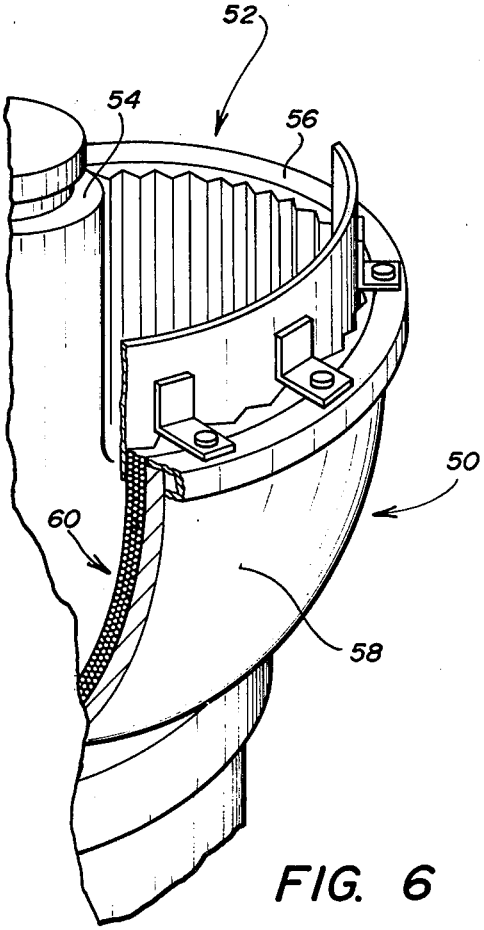
FIG. 6 is a partial perspective view of a vibratory finishing machine incorporating a liner formed of the composition having improved wear resistant and compression resilient properties of the present invention.

The compositions described hereinbefore which have improved wear resistant and compression resilient properties have unlimited uses. One especially desirable use of the composition is as a liner for a vibratory finishing machine such as that illustrated in FIG. 6. The vibratory finishing machine 50 depicted is of the type including a toroidal bowl or hopper 52. The toroidal bowl 52 may also be considered as comprising an annular hopper having a generally U-shaped cross section. The bowl or hopper 52 has an interior upper circular rim 54 and an outer upper circular rim 56 each extending around the entire circumference of the hopper 52.

The vibratory finishing machine 50 utilizes a hopper 52 comprising an outer bowl or tub 58. The tub 58 is typically formed of a suitable metal, such as steel, and is mounted on suitable springs (not shown) so as to permit the vibration of the hopper 52 and the contents thereof. A liner 60, formed of the composition of the present invention, extends over the interior of tub 58. It will be understood that the present invention is not limited to liners for vibratory finishing machines having the particular construction illustrated in FIG. 7, but may be employed in conjunction with any standard industrial abrasive-type machine and/or grinding or polishing apparatus employing a wheel, a drum or barrel requiring a wear resistant and compression resilient covering to maintain a grinding or abrasive belt in contact with the metal or substance being polished.

In order to depict the improved wear resistant and compression resilient properties of the compositions of the present invention the following example is given. However, it is to be understood that the example is for illustrative purposes and is not to be construed as unduly limiting the scope of the present invention.

EXAMPLE

A liner for a vibratory finishing machine was constructed using a moderately soft urethane castable material, e.g. having a durometer gauge hardness of from 35 to 55 in which a plurality of three-eighths inch diameter ceramic balls were randomly positioned within the substrate in a manner similar to that shown in FIG. 1. The liner produced from the urethane substrate and the ceramic balls has a standard thickness of three-fourths inch and was positioned within and tested under normal operating conditions in a vibratory finishing machine. For comparison, a urethane liner of the prior art was positioned within a vibratory finishing machine and operated under normal conditions in substantially the same manner. Similar parts, as to weight and configuration were positioned within each of the vibratory finishing machines. The liner of the machine employing the prior art urethane liner failed in approximately 20 hours. However, the vibratory finishing machine containing the liner formed from the improved composition of the invention showed only negligible wear after 20 hours testing, e.g., the surface of the ceramic balls were merely exposed similar in configuration to that shown in FIG. 4. The above example clearly indicates the improved wear resistant and compression resilient properties of the compositions of the present invention. Further, it will be understood that the present invention comprises a composition having improved wear resistant and compression resilient properties which can be employed as liners for vibratory finishing machines, other industrail finishing and polishing machines, and the like. Perhaps the most important advantage deriving from the improved composition of the invention is the hard abrasive resistant surface provided within the composition while at the same time providing a soft elastic cushion which prevents the fracturing of the abrasion resistant materials. Another important advantage deriving from the composition of the present invention is that the composition is economical to manufacture and can readily be tailored to any particular need or desire. Other advantages deriving from the invention will readily suggest themselves to those skilled in the art.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

I claim:

1. A composition having improved wear resistant and compression resilient properties which is particularly suited for use as a liner for an industrial vibratory finishing machine to reduce abrasion damage, comprising:

a compressible elastomeric substrate having a working surface subject to abrasion, and a non-working surface not subject to abrasion in spaced relationship with the working surface; and a plurality of separate abrasive resistant members of predetermined solid geometric configurations comprising particles and randomly arranged between the surfaces of said substrate with at least certain of said abrasive resistant members having surfaces positioned closely adjacent to the working surface, and with an effective amount of substrate between each of said abrasive resistant members and the non-working surface of said substrate to allow compression of said abrasive resistant members within said substrate.

2. The composition of claim 1 wherein said elastomeric substrate is formed from a material selected from the group including natural and synthetic elastomers.

3. The composition of claim 2 wherein said elastomeric substrate comprises polyurethane.

4. The composition of claim 1 wherein said abrasive resistant members are formed of naturally occurring compositions selected from the group consisting of diamond, corundum, emery, garnet, granite, pumice, pumicite and quartz conglomerate.

5. The composition of claim 1 wherein said abrasive resistant members are formed of synthetically produced compositions and are selected from the group consisting of diamond, fused alumina, glass, silicon carbide, tantalum carbide, tungsten carbide, and steel.

6. The composition of claim 5 wherein said abrasive resistant members are in the configuration of a ball.

7. The composition of claim 1 wherein the effective amount of elastomeric material comprises a layer of elastomeric material with predetermined thickness bonded to the non-working surface of the elastomeric substrate having the abrasive resistant members therein.

8. A liner having improved wear resistant and compression resilient properties for use in a vibratory finishing machine to reduce abrasion damage, comprising:

a first compressible elastomeric substrate having a working surface subject to abrasion, and a non-working surface not subject to abrasion in spaced relationship with the working surface; and a multiplicity of substantially spherical solid abrasive resistant members comprising ceramic particles and randomly positioned between the surfaces of said first substrate in at least one substantially planar layer with each of said abrasive resistant members comprising one of said layers having a surface positioned closely adjacent to the working surface, and with an effective amount of substrate between all of said abrasive resistant members and the non-working surface of said first substrate to allow compression of the abrasive resistant members within the first substrate.

9. The liner of claim 8 wherein the effective amount of elastomeric material comprises a second elastomeric substrate of predetermined thickness bonded to the non-working surface of the first elastomeric substrate.

10. The liner of claim 9 wherein the first and second elastomeric substrates are formed of polyurethane material.

* * * * *